US005226863A

United States Patent [19]

Kimura

[11] Patent Number: 5,226,863

[45] Date of Patent: Jul. 13, 1993

[54] POWDERED DEVELOPER FILLING DEVICE

[75] Inventor: Masayoshi Kimura, Hyogo, Japan

[73] Assignee: Miki Minolta Industries Co., Ltd., Miki, Japan

[21] Appl. No.: 789,016

[22] Filed: Nov. 7, 1991

[30] Foreign Application Priority Data

Nov. 8, 1990 [JP] Japan ..... 2-304608

[51] Int. Cl.[5] ..... B65B 3/04

[52] U.S. Cl. ..... 141/8; 141/86; 141/89; 141/93

[58] Field of Search ..... 141/85, 86, 89, 90, 141/93, 311 A, 4, 5, 8

[56] References Cited

U.S. PATENT DOCUMENTS

| | | | |
|---|---|---|---|
| 2,524,560 | 10/1950 | Cote | 141/93 X |
| 2,874,733 | 2/1959 | Sessler et al. | 141/93 X |
| 3,384,134 | 5/1968 | Hillerns | 141/90 X |
| 4,096,894 | 6/1978 | Guy | 141/93 |
| 4,312,388 | 1/1982 | Hager et al. | 141/93 |
| 4,350,187 | 9/1982 | Trusselle | 141/90 |
| 4,572,252 | 2/1986 | Ponzi et al. | 141/90 |
| 4,751,948 | 6/1988 | Hertig et al. | 141/67 |
| 4,987,934 | 1/1991 | Groom | 141/89 |

*Primary Examiner*—Ernest G. Cusick

*Attorney, Agent, or Firm*—Burns, Doane, Swecker & Mathis

[57] ABSTRACT

A powdered developer filling device for filling a developer container with a powdered developer comprises a hopper for containing the powdered developer, feeding means for feeding the developer contained in the hopper into the developer container from a feed port through a mouth portion of the developer container, conveying means for conveying the developer container to a feed position where the developer is fed into the developer container from the feeding means, and recovering means for recovering the developer spilled from the above feed port by blowing air against the vicinity of the feed position where the developer is fed into the developer container from the feeding means.

9 Claims, 8 Drawing Sheets

POWDERED DEVELOPER FILLING DEVICE

BACKGROUND OF THE INVENTION

1. Field of the Invention

The present invention relates generally to a powdered developer filling device used for filling a developer container with a powdered developer, and more particularly, to a powdered developer filling device so adapted as to feed a powdered developer into a developer container from a feed port in an end of a feed nozzle to fill the developer container with the powdered developer.

2. Description of the Prior Art

In feeding a powdered developer into a developing device in an electrophotographic apparatus such as a copying machine or a printer, a developer container is generally filled with a powdered developer to feed the powdered developer into a developing device from the developer container thus filled with the powdered developer.

In filling the developer container with the powdered developer, a filling device has been heretofore generally used so adapted that an end of a feed nozzle for feeding a powdered developer contained in a hopper into a developer container is inserted into a mouth portion of the developer container and the developer is fed into the developer container from a feed port in the end of the feed nozzle.

However, when the powdered developer is thus fed into the developer container from the feed port in the end of the feed nozzle, the developer fed is brown up in the developer container, and the developer thus brown up leaks out of the developer container through a clearance between the feed port in the end of the feed nozzle and the mouth portion of the developer container.

Consequently, these arise some problems. For example, the developer thus leaking out of the developer container adheres to the outer wall of the developer container to make the developer container dirty. In addition, the developer leaking out as described is scattered outward to damage the environment.

Even in the above described conventional filling device, therefore, a suction nozzle is provided in the vicinity of the feed port in the end of the feed nozzle for feeding the developer into the developer container, to suck the developer leaking out through the clearance between the feed port in the end of the feed nozzle and the mouth portion of the developer container to recover the same.

However, even when the developer leaking out through the clearance between the feed port in the end of the feed nozzle and the mouth portion of the developer container is thus sucked by the suction nozzle to be recovered, such a phenomenon occurs that the developer adheres to the outer wall of the developer container to make the developer container dirty and the developer is scattered around to damage the environment.

SUMMARY OF THE INVENTION

An object of the present invention is to prevent a phenomenon that when a powdered developer is fed into a developer container from a feed nozzle to fill the developer container with the developer, the powdered developer adheres to the outer wall of the developer container to make the developer container dirty and the developer is scattered around to damage the environment.

The inventors of the present application have investigated the cause of the phenomenon that when a powdered developer is fed into a developer container from a feed nozzle to fill the developer container with the powdered developer, the powdered developer adheres to the outer wall of the developer container to make the developer container dirty and the developer is scattered around to damage the environment.

As a result, the following has been clear: More specifically, when the powdered developer is fed into the developer container from the feed nozzle, the developer adheres to, for example, the inner wall of the feed nozzle. At the time point where the developer thus adhering is accumulated to some extent, the developer is spilled from the feed port in the end of the feed nozzle. Consequently, the developer thus spilled adheres to the outer wall of the developer container to make the developer container dirty, and the developer thus spilled is scatted around to damage the environment.

In the present invention, a powdered developer filling device for filling a developer container with a powdered developer comprises a hopper for containing the powdered developer, feeding means for feeding the developer contained in the hopper into the developer container from a feed port through a mouth portion of the developer container, conveying means for conveying a developer container to a feed position where the developer is fed into the developer container from the feeding means, and recovering means for recovering the developer spilled from the above feed port by blowing air against the vicinity of the feed position where the developer is fed into the developer container from the feeding means.

In the powdered developer filling device, the developer container is conveyed by the above conveying means to the feed position where the developer is fed into the developer container by the feeding means. The developer contained in the hopper is then fed into the developer container thus introduced into the feed position from the feed port through the mouth portion of the developer container by the feeding means.

Furthermore, air is blown against the vicinity of the above feed position at suitable timing to recover the developer spilled from the feed port by the above recovering means.

When air is blown against the vicinity of the above feed position at suitable timing to recover the developer spilled from the feed port by the recovering means, the phenomenon is eliminated that the developer spilled from the feed port adheres to the outer wall of the developer container to make the developer container dirty and the the developer spilled is scatted around to damage the environment.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
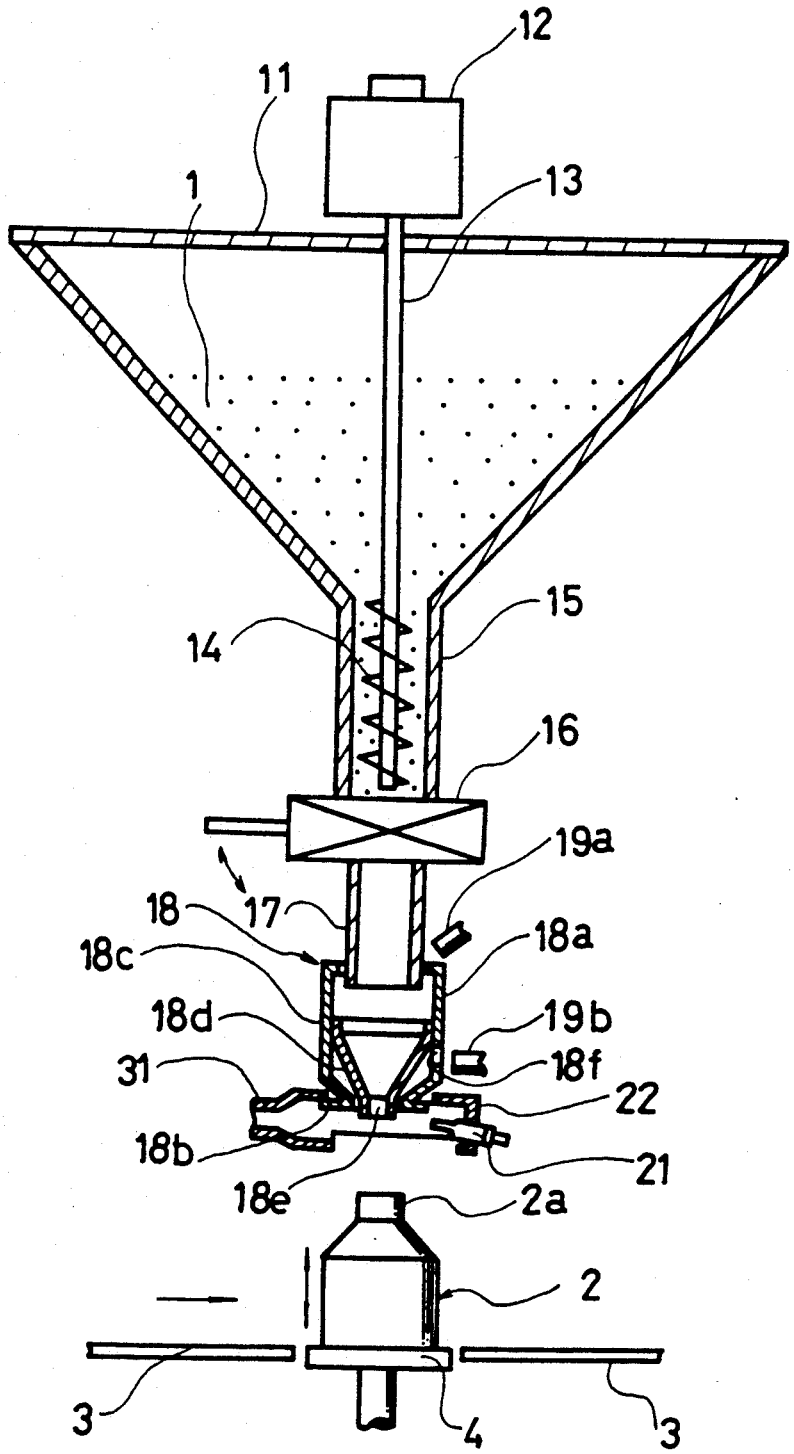
FIG. 1 is a schematic diagram showing a powdered developer filling device according to an embodiment of the present invention.

In a powdered developer filling device according to the present embodiment, a motor 12 is provided above a hopper 11 containing a powdered developer 1, and an auger screw 14 is provided in the lower part of an axis of rotation 13 extending downward from the motor 12, as shown in FIG. 1. The axis of rotation 13 is inserted into the above hopper 11, and the auger screw 14 provided in the lower part of the axis of rotation 13 is inserted into a guide pipe 15 extending downward from the hopper 11.

When the above axis of rotation 13 provided with the auger screw 14 in its lower part is rotated by the above motor 12, the above developer 1 contained in the hopper 11 is introduced into the guide pipe 15 by the rotation of the auger screw 14.

Furthermore, a shutter 16 for feeding the developer 1 and stopping the feeding is provided in the lower end of the guide pipe 15 extending downward from the hopper 11. In addition, a feed pipe 17 is provided downward from the shutter 16. The lower end of the feed pipe 17 is inserted into a feed nozzle 18 provided below the feed pipe 17.

The above described feed nozzle 18 comprises an outer pipe **18*c* contracted in such a shape as to be tapered downward from a cylindrical body portion 18*a* and having a flange portion 18*b* expanding outward in the radial direction provided in its lower end and an inner pipe 18*d* contracted in such a shape as to be tapered downward from a position at a suitable height of the inner peripheral surface of the outer pipe 18*c* inside of the outer pipe 18*c* and having a feed port 18*e* for feeding the developer 1 into a developer container 2 provided in its end, and the lower portion thereof is of double-pipe construction. In the portion of double-pipe construction, a suction port 18*f* is opened into a suitable portion of the outer pipe 18*c***.

When the above described shutter 16 is opened, the developer 1 introduced into the above described guide pipe 15 is introduced into the feed pipe 17 through the shutter 16, and the developer 1 is further introduced into the feed nozzle 18 through the feed pipe 17.

When the developer 1 is thus fed into the feed nozzle 18 through the feed pipe 17, the developer 1 fed into the feed nozzle 18 is liable to be blown up in the feed nozzle 18 to leak out through a clearance between the feed pipe 17 and the feed nozzle 18. In the present embodiment, therefore, a suction nozzle **19*a* is arranged in the vicinity of the upper end of the feed nozzle 18 into which the feed pipe 17 is inserted, to suck the developer 1 leaking out through the clearance between the feed pipe 17 and the feed nozzle 18**.

Figure 2:
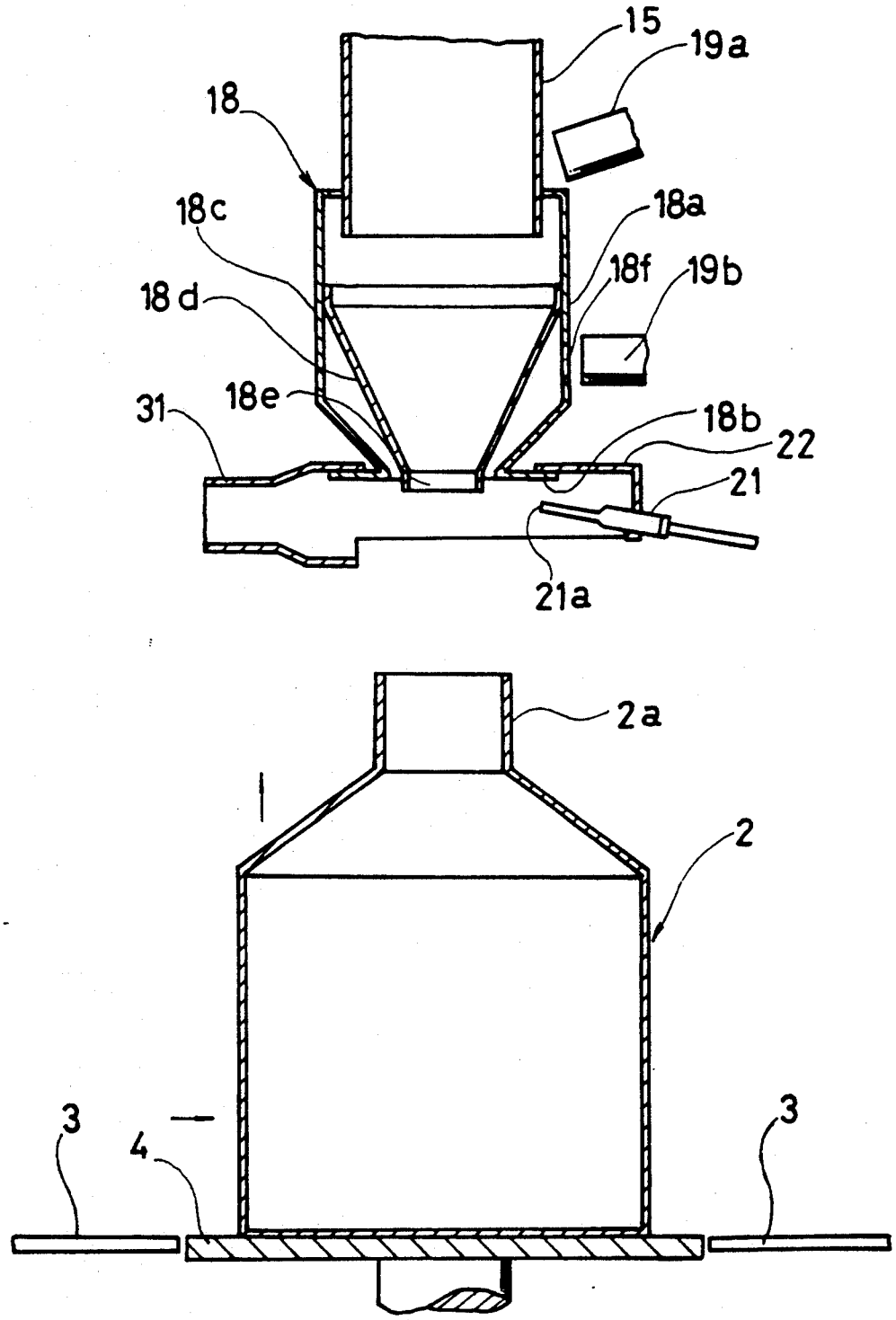
FIG. 2 is a partially enlarged view illustrating a state where an empty developer container for containing a powdered developer is mounted on a mounting stand in the powdered developer filling device according to the present embodiment.

On the other hand, in containing the powdered developer 1 in the bottle-shaped developer container 2 from the above described feed nozzle 18, the developer container 2 is conveyed by a conveying member 3 such as a belt conveyer with an opened mouth portion **2*a* of the developer container 2 being directed upward, to be mounted on a mounting stand 4 moving up and down which is provided directly below the above feed nozzle 18, as shown in FIGS. 1 and 2**.

Then, when the developer container 2 is thus mounted on the mounting stand 4, the mounting stand 4 is raised by an up-and-down device such as a cylinder (not shown). The feed port **18*e* in the end of the inner pipe 18*d* in the feed nozzle 18 is inserted into the mouth portion 2*a* of the above developer container 2 mounted on the mounting stand 4, and the upper edge of the mouth portion 2*a* of the developer container 2 is brought into close contact with the flange portion 18*b* provided in the lower end of the outer pipe 18*c* in the above feed nozzle 18**.

Figure 4:
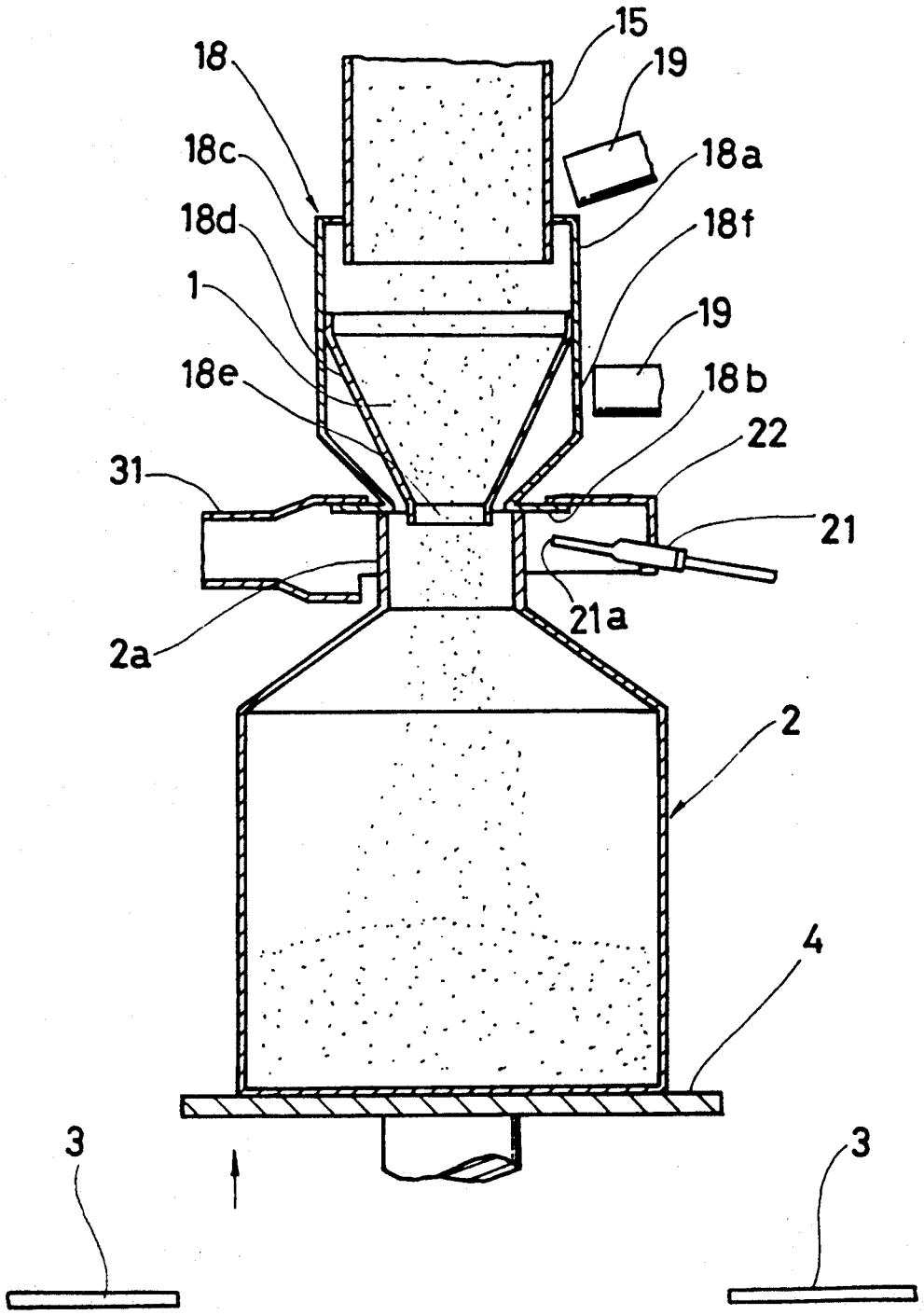
FIG. 4 is a partially enlarged view illustrating a state where the powdered developer is fed into the developer container in the powdered developer filling device according to the present embodiment.
Figure 5:
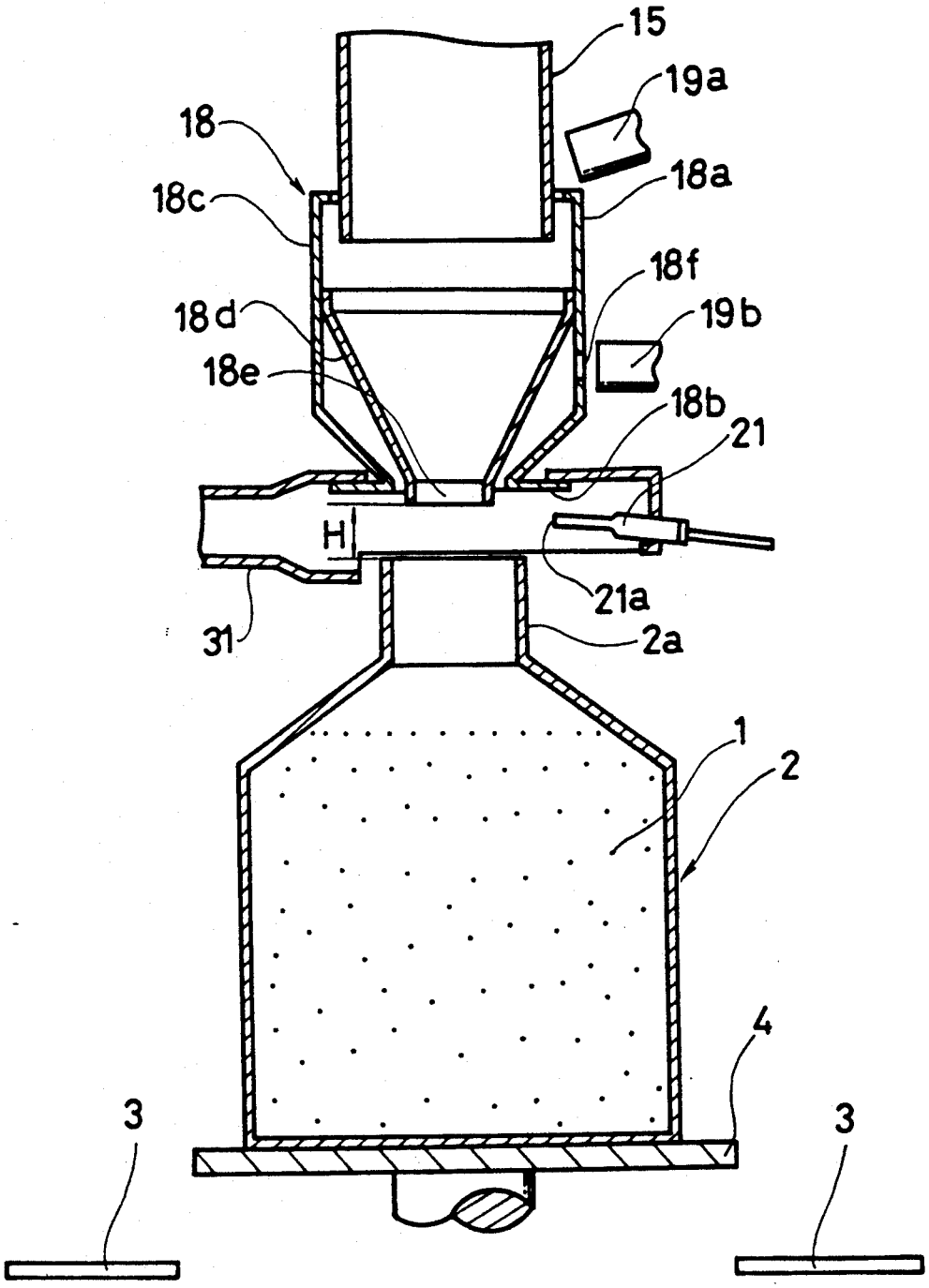
FIG. 5 is a partially enlarged view illustrating a state where the developer container is filled with the powdered developer and then, the mounting stand is lowered to introduce the developer container into the retreat position in the powdered developer filling device according to the present embodiment.
Figure 6:
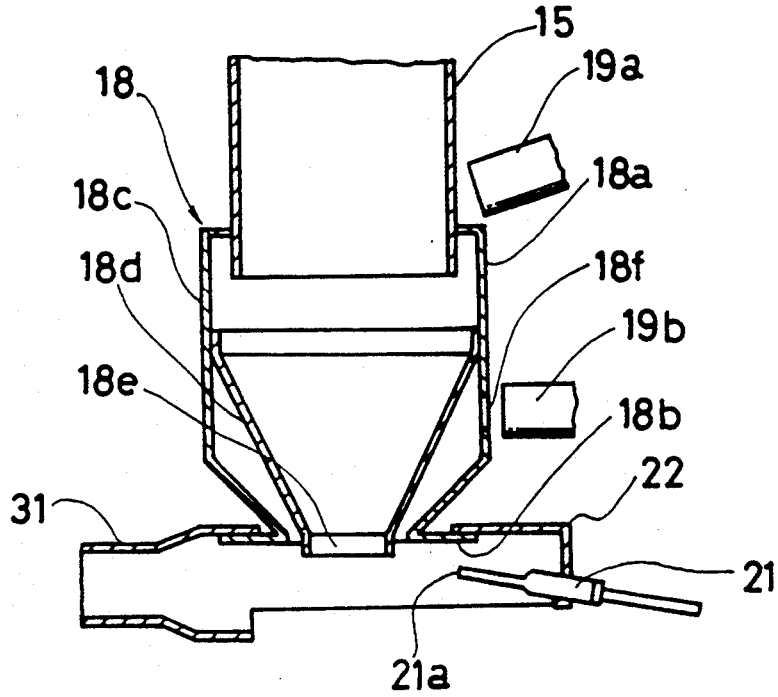
FIG. 6 is a partially enlarged view illustrating a state where the mounting stand is lowered to return the developer container filled with the powdered developer in the powdered developer filling device according to the present embodiment.
Figure 6:
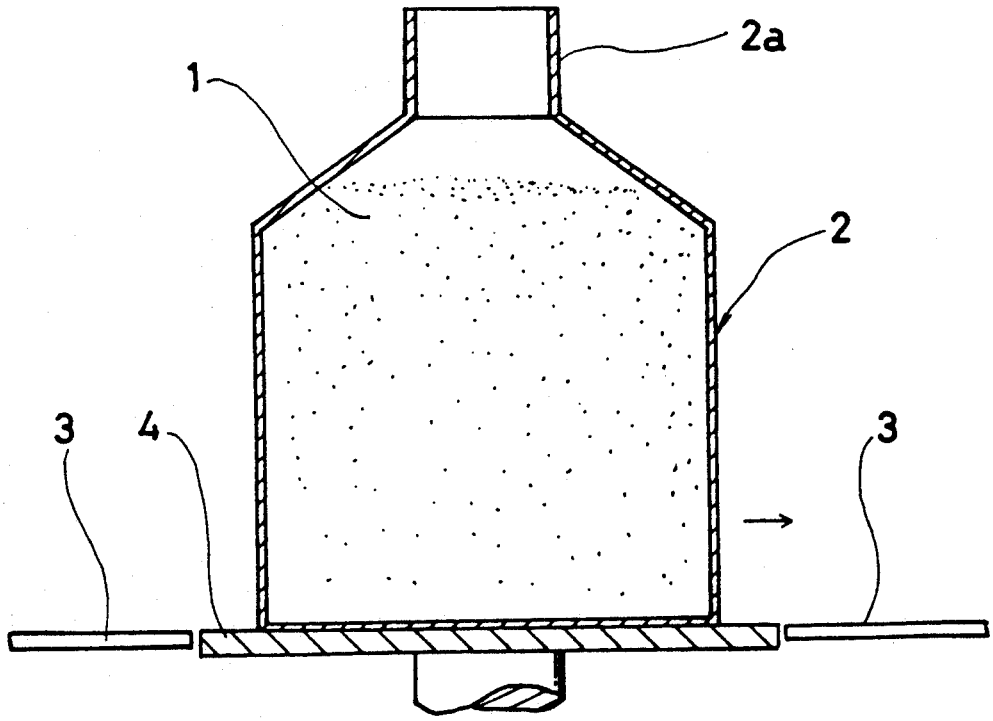

As shown in FIG. 4, the developer 1 introduced into the feed nozzle 18 through the above feed pipe 17 is fed into the developer container 2 from the feed port **18*e* in the end of the inner pipe 18*d* through the inner pipe 18*d* in the feed nozzle 18 to fill the developer container 2 with the developer 1 with the feed port 18*e* of the feed nozzle 18 being inserted into the mouth portion 2*a* of the developer container 2 and the upper edge of the mouth portion 2*a* of the developer container 2 being brought into close contact with the flange potion 18*b* provided in the lower end of the outer pipe 18*c* in the above feed nozzle 18**.

When the developer 1 is thus fed into the developer container 2 from the feed port **18*e*, the developer 1 fed into the developer container 2 might be blown up, to leak out through the clearance between the feed port 18*e* of the feed nozzle 18 and the mouth portion 2*a* of the developer container 2. In the present embodiment, therefore, a suction nozzle 19*b* is arranged in the vicinity of the suction port 18*f* provided in a suitable portion of the outer pipe 18*c* in the portion of double-pipe construction of the above described feed nozzle 18, to suck the developer 1 leaking out through the clearance between the feed port 18*e* of the feed nozzle 18 and the mouth portion 2*a* of the developer container 2**.

In the powdered developer filling device according to the present embodiment, an injection nozzle 21 is attached to the vicinity of the end of the above feed nozzle 18 by a fitting 22 such that a flat injection port 21*a* for injecting air in an end of the injection nozzle 21 is directed toward the vicinity of the feed port 18*e* in the end of the feed nozzle 18.

Furthermore, a dust collecting hood 31 for recovering the developer 1 spilled from the above feed port 18*e* together with air injected from the above injection port 21*a* is attached to the vicinity of the end of the feed nozzle 18 such that it is opposed to the injection port 21*a* of the above injection nozzle 21 with the feed port 18*e* of the above feed nozzle 18 being interposed therebetween, and the dust collecting hood 31 is connected to a pump for suction (not shown).

Air is blown against the vicinity of the feed port 18*e* in the end of the above feed nozzle 18 from the injection port 21*a* in the end of the injection nozzle 21, to blow away the developer 1 spilled from the feed port 18*e* of the feed nozzle 18, and the developer 1 thus blown away, together with the air, is recovered through the above dust collecting hood 31.

The above injection nozzle 21 is provided in the vicinity of the end of the feed nozzle 18 such that the position in which the injection nozzle 21 is mounted and the angle at which the injection nozzle 21 is mounted can be freely adjusted. In the example shown in FIGS. 1 to 6, the injection nozzle 21 is attached to the vicinity of the end of the feed nozzle 18 with the injection port 21*a* in the end of the above injection nozzle 21 being directed upward at a small angle with the horizontal plane, to diagonally blow away air upward against the vicinity of the feed port 18*e* in the end of the feed nozzle 18 from the injection port 21*a*.

Figure 3:
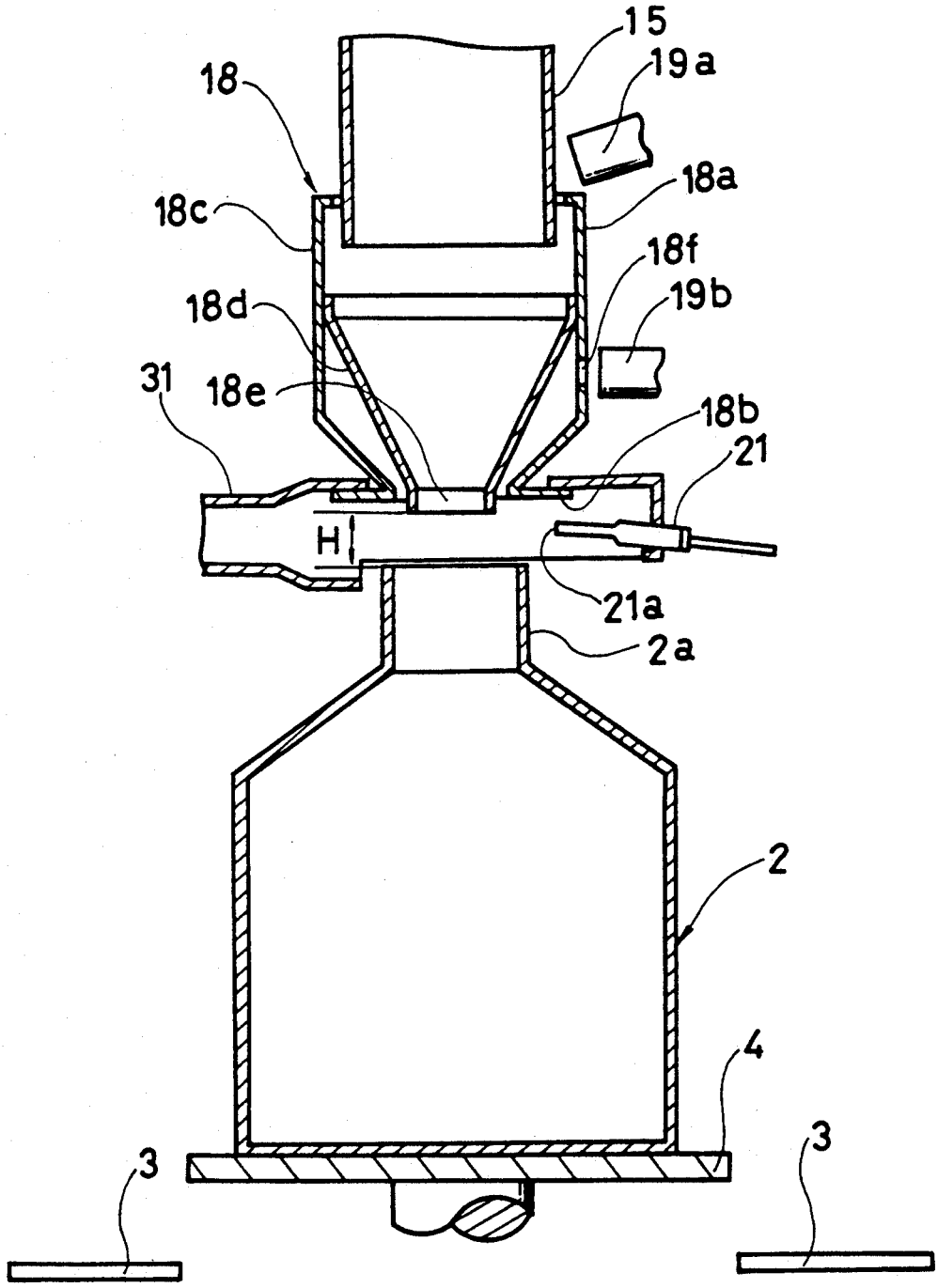
FIG. 3 is a partially enlarged view illustrating a state where the mounting stand on which the empty developer container for containing the powdered developer is mounted is raised to introduce the developer container into a retreat position in the powdered developer filling device according to the present embodiment.

Furthermore, it is while the empty developer container 2 mounted on the mounting stand 4 by the above conveying member 3 is raised by the up-and-down device such as a cylinder that air is injected from the injection port 21*a* in the end of the above injection nozzle 21. The injection of air from the injection port 21*a* is stopped at the time point where the developer container 2 is raised to a retreat position where the clearance in the vertical direction between the lower end of the feed port 18*e* of the feed nozzle 18 and the upper end of the mouth portion 2*a* of the developer container 2 becomes a required distance (H), as shown in FIG. 3.

The empty developer container 2 mounted on the mounting stand 4 is raised in a state where the injection of air from the injection port 21*a* is stopped. Even when the developer 1 is fed into the developer container 2 from the feed port 18*e* in the end of the feed nozzle 18 to fill the developer container 2 with the developer 1, as shown in FIG. 4, air is prevented from being injected from the injection port 21*a*. In the step of feeding the developer 1 into the developer container 2 from the feed port 18*e* in the end of the feed nozzle 18, however, air may be injected from the injection port 21*a*.

Even when the developer container 2 is filled with the developer 1 and then, the mounting stand 4 on which the developer container 2 is mounted is lowered, air is prevented from being injected from the injection port 21*a* until the developer container 2 reaches the retreat position where the clearance in the vertical direction between the lower end of the feed port 18*e* of the feed nozzle 18 and the upper end of the mouth port 2*a* of the developer container 2 becomes a required distance (H). Thereafter, air is injected from the injection port 21*a*, to blow away the developer 1 spilled from the feed port 18*e* of the feed nozzle 18, and the developer 1 thus blown away, together with air, is recovered through the above dust collecting hood 31. In the example shown in FIGS. 1 to 6, however, air is diagonally blown upward from the above injection port 21*a*. Accordingly, even if air is injected from the injection port 21*a* in the step of lowering the developer container 2 filled with the developer 1, the air injected is hardly blown into the developer container 2 to scatter the developer 1. In the example shown in FIGS. 1 to 6, therefore, air may be injected from the injection port 21*a* before the developer container 2 filled with the developer 1 reaches the retreat position.

On the other hand, air is always sucked by the above described dust collecting hood 31.

The inventors have examined a preferred angle which air injected from the injection port 21*a* of the above injection nozzle 21 makes with the horizontal plane under the conditions that air is not injected from the injection port 21*a* in a state where the developer container 2 is placed above the retreat position where the clearance in the vertical direction between the lower end of the feed port 18*e* of the feed nozzle 18 and the upper end of the mouth portion 2*a* of the developer container 2 becomes a required distance (H), while being injected in a state where it is placed below the above retreat position.

In the step of raising the vacant developer container 2, when air injected from the injection port 21*a* of the injection nozzle 21 strikes this empty developer container 2, the developer container 2 may, in some cases, fall on the mounting stand 4 and be shifted in position. Furthermore, in the step of lowering the developer container 2 filled with the developer 1, when air injected from the above injection port 21*a* is blown into the developer container 2 filled with the developer 1, the developer 1 in the developer container 2 may, in some cases, be scattered from the developer container 2. In a state where the developer container 2 is placed in the above retreat position, therefore, it is preferable that air injected from the injection port 21*a* of the injection nozzle 21 does not strike the mouth portion 2*a* of the developer container 2.

Furthermore, when air injected from the injection port 21*a* of the injection nozzle 21 is blown into the feed port 18*e* of the feed nozzle 18, the developer 1 which adhered to, for example, the inner peripheral surface of the feed nozzle 18 may, in some cases, be scattered by the air blown. Therefore, it is preferable that air injected from the injection port 21*a* of the injection nozzle 21 does not strike the feed port 18*e* of the feed nozzle 18.

Figure 7:
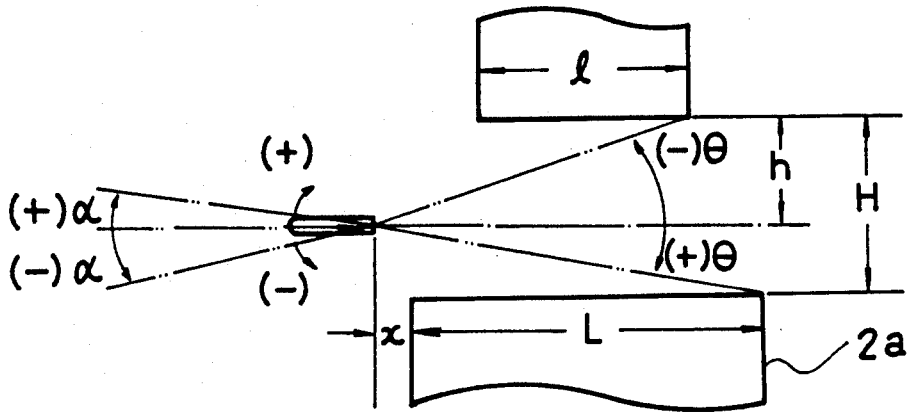
FIG. 7 is a schematic diagram illustrating a preferred angle which air injected from an injection port of an injection nozzle makes with the horizontal plane in the powdered developer filling device according to the present embodiment.

As shown in FIG. 7, $\theta$ [degree] is taken as an angle which air injected from the injection port 21*a* of the injection nozzle 21 makes with the horizontal plane. When (−) indicates a case where air injected from the injection port 21*a* is directed upward with respect to the horizontal plane, and (+) indicates a case where air injected from the injection port 21*a* is directed downward with respect to the horizontal plane, it is preferable that the angle $\theta$ [degree] which air injected from the injection port 21*a* of the injection nozzle 21 makes with the horizontal plane is set to fall in the range as expressed by the following expression.

$$-(180/\pi)\cdot\text{arc tan}\,[2h/(L+1+2x)] \leqq \theta \leqq$$

$+(180/\pi)\cdot\text{arc tan}\,[(H-h)/(L+x)]$

In the above described expression, H denotes a distance in the vertical direction between the lower end of the feed port 18*e* of the feed nozzle 18 and the upper end of the mouth portion 2*a* of the developer container 2 in a case where the developer container 2 is placed in the retreat position, h denotes a distance in the vertical direction between the lower end of the feed port 18*e* of the feed nozzle 18 and the injection port 21*a* of the injection nozzle 21, L denotes the diameter of the mouth portion 2*a* of the developer container 2, 1 denotes the diameter of the feed port 18*e* of the feed nozzle 18, and x denotes a distance in the horizontal direction between the mouth portion 2*a* of the developer container 2 and the injection port 21*a* of the injection nozzle 21.

Furthermore, as a result of examining the velocity of injection ($v_1$) of air injected from the injection port 21*a* of the injection nozzle 21 and the amount of injection ($m_1$) of the air as well as the velocity of suction ($v_2$) of air by the dust collecting hood 31 and the amount of suction ($m_2$) of the air, it is preferable that the following conditions are satisfied:

$$v_1 \leqq v_2: \quad v_1 \geqq 20\ [\text{m/sec}]$$
$$v_2 \geqq 25\ [\text{m/sec}]$$
$$m_1 \leqq m_2: \quad m_1 \geqq 1.0\ [\text{m}^3/\text{sec}]$$
$$m_2 \geqq 1.2\ [\text{m}^3/\text{sec}]$$

Figure 8:
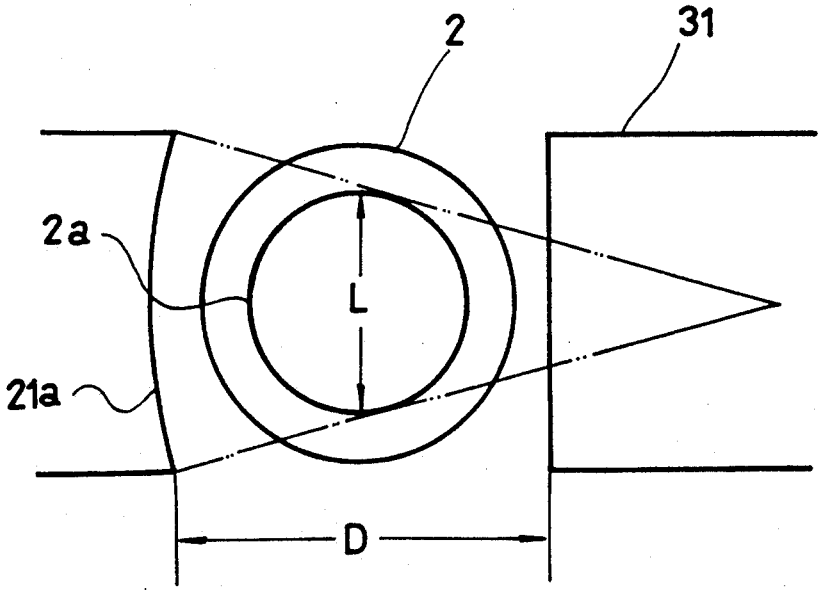
FIG. 8 is an illustration showing the state of air injected from an injection port formed in the shape of a circular arc which is concave in its central part.

Furthermore, besides using as the above described injection nozzle 21 one having a straight injection port 21*a* in its end, one having an injection port 21*a* formed in the shape of a circular arc which is concave in its central part as shown in FIG. 8, and one having an injection port 21*a* formed in the shape of a circular arc which is concave in its central part and contracted in such a shape as to be slightly tapered toward its end on both sides may be used.

Figure 9:
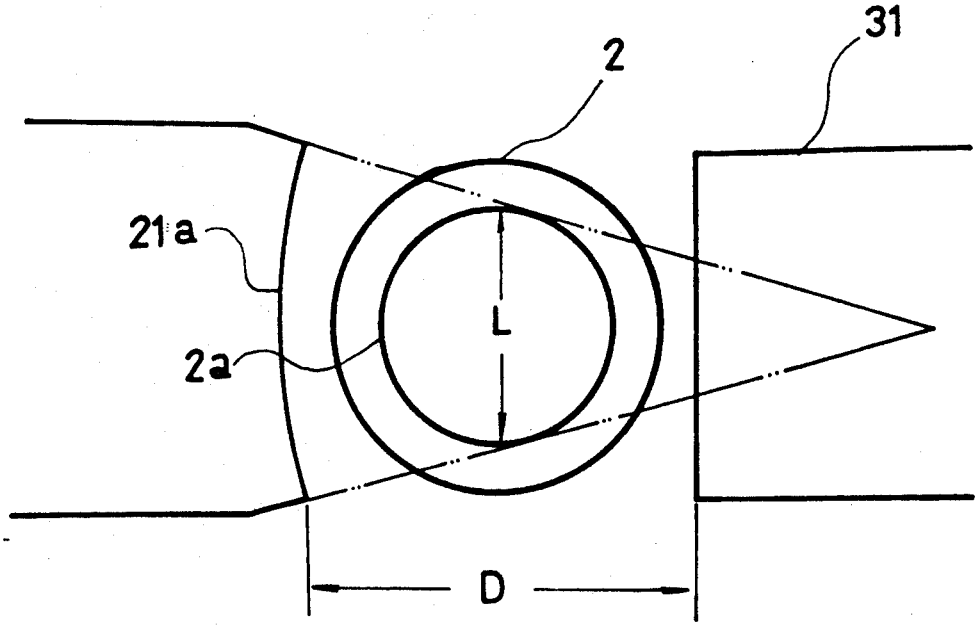
FIG. 9 is an illustration showing the state of air injected from an injection port which is formed in the shape of a circular arc which is concave in its central part and contracted in such a shape as to be slightly tapered toward its end on both sides.

Consider a case where the injection nozzle 21 having an injection port 21*a* formed in the shape of a circular arc which is concave in its central part as shown in FIGS. 8 and 9 is used. In this case, when air is injected from the injection port 21*a* of the injection nozzle 21, the air injected from the injection port 21*a* is gradually narrowed to converge into a focus. As a result, the developer 1 spilled from the feed port 18*e* of the feed nozzle 18 is introduced into the dust collecting hood 31 while being collected by the air injected from the above injection port 21*a*.

In order to reliably introduce the developer 1 spilled from the feed port 18*e* of the feed nozzle 18 into the dust collecting hood 31 by air injected from the injection port 21*a* even when the air injected from the injection port 21*a* is thus gradually narrowed, it is preferable that the air is injected with the width thereof being larger than that of the mouth portion 2*a* of the developer container 2 at the time point where the air injected from the injection port 21*a* passes above the mouth portion 2*a* of the developer container 21. In addition, it is desirable that the distance from the injection port 21*a* to the focus into which the air gradually narrowed converges is approximately one to three times a distance (D) from the injection port 21*a* to the dust collecting hood 31.

Experiments of sequentially filling the developer container 2 in a bottle shape with the powdered developer 1 from the feed port 18*e* of the feed nozzle 18 are conducted using the powdered developer filling device according to the above described embodiment.

In the following experiments, air is prevented from being injected from the injection port 21*a* in a state where the developer container 2 is placed above the retreat position where the clearance in the vertical direction between the lower end of the feed port 18*e* of the feed nozzle 18 and the upper end of the mouth portion 2*a* of the developer container 2 is a required distance (H). The experiments of filling 100 developer containers 2 with the powdered developer 1 are conducted by changing, for example, the angle at which the above injection nozzle 21 is mounted and the position where it is mounted, the velocity of injection ($v_1$) of air injected from the injection port 21*a* of the injection nozzle 21 and the amount of injection ($m_1$) of the air, and the velocity of suction ($v_2$) of air by the dust collecting hood 31 and the amount of suction ($m_2$) of the air, to examine the degree to which the powdered developer 1 adheres to the outer wall of the developer container 2 to make the developer container 2 dirty.

EXPERIMENTS 1 TO 7

In the experiments, the diameter (1) of the feed port of the feed nozzle is taken as 30 mm, the diameter (L) of the mouth portion of the developer container is taken as 45 mm, the distance from the injection port to the dust collecting hood is taken as 50 mm, the distance (H) in the vertical direction between the lower end of the feed port of the feed nozzle and the upper end of the mouth portion of the developer container in the retreat position is taken as 25 mm, the distance (h) in the horizontal direction between the lower end of the feed port of the feed nozzle and the injection port of the injection nozzle is taken as 25 mm which is approximately the same as the above described distance (H), the distance (x) in the horizontal direction between the mouth portion of the developer container and the injection port of the injection nozzle is taken as approximately 0 mm, the amount of injection ($m_1$) of air injected from the injection port of the injection nozzle is taken as 3.0 $m^3$/min, and the amount of suction ($m_2$) of air by the dust collecting hood 31 is taken as 3.5 $m^3$/min.

In order to change the angle ($\theta$) which air injected from the injection port of the injection nozzle makes with the horizontal plane under the above described conditions, the experiments are conducted by changing the angle ($\alpha$) which the injection port of the above injection nozzle makes with the horizontal plane to +10°, +5°, −5°, −10°, −20°, −29° and −35°, to evaluate the dirt of the developer container due to the adhesion of the powdered developer and show the results thereof in the same table 1.

Meanwhile, the angle ($\alpha$) which the injection port of the injection nozzle makes with the horizontal plane is marked with (−) when the injection port is directed upward, while being marked with (+) when the injection port is directed downward. In addition, for the evaluation of the dirt of the developer container, ◎ indicates a case where no powdered developer adheres to the developer container, ○ indicates a case where a small amount of powdered developer adheres to the developer container, and Δ indicates a case where a powdered developer adheres to the developer container, which is not practically a program.

TABLE 1

| Experiment | 1 | 2 | 3 | 4 | 5 | 6 | 7 |
|---|---|---|---|---|---|---|---|
| α (°) | +10 | +5 | −5 | −10 | −20 | −29 | −35 |
| Evaluation | Δ | Δ | ○ | ◎ | ∘ | ○ | Δ |

In the experiments 1 and 2 in which the angle (α) which the injection port of the injection nozzle makes with the horizontal plane is plus, it is because air injected from the injection port of the injection nozzle is blown into the mouth portion of the developer container so that the powdered developer contained in the developer container is brown up and the powdered developer thus blown up adheres to the outer wall of the developer container that the powdered developer adheres to the developer container. Furthermore, in the experiment 7 in which the angle (α) which the injection port of the injection nozzle makes with the horizontal plane is significantly minus, it is because air injected from the injection port of the injection nozzle is blown into the feed port of the feed nozzle so that the developer adhering to, for example, the inner surface of the feed nozzle is scattered and the powdered developer thus scattered adheres to the outer wall of the developer container that the powdered developer adheres to the developer container.

Meanwhile, when air is injected from the injection port of the injection nozzle, the air is injected within plus or minus approximately 5 degrees with respect to the angle (α) which the injection port of the injection nozzle makes with the horizontal plane. Accordingly, when the angle (θ) which air injected from the injection port of the injection nozzle makes with the horizontal plane is adjusted on the basis of the angle (α) which the injection port of the injection nozzle makes with the horizontal plane, it is necessary to consider the range of plus or minus approximately 5 degrees.

EXPERIMENTS 8 to 29

In the experiments, the diameter (l) of the feed port of the feed nozzle is taken as 30 mm, the diameter (L) of the mouth portion of the developer container is taken as 45 mm, the distance from the injection port to the dust collecting hood is taken as 50 mm, the distance (x) in the horizontal direction between the mouth portion of the developer container and the injection port of the injection nozzle is taken as approximately 0 mm, the amount of injection ($m_1$) of air injected from the injection port of the injection nozzle is taken as 3.0 $m^3$/min, and the amount of suction ($m^2$) of air by the dust collecting hood (31) is taken as 3.5 $m^3$/min.

The experiments are conducted by changing the distance (H) in the vertical direction between the lower end of the feed port of the feed nozzle and the upper end of the mouth portion of the developer container in the retreat position, the distance (f) in the vertical direction between the lower end of the feed port of the feed nozzle and the injection port of the injection nozzle, and the angle (α) which the injection port of the injection nozzle makes with the horizontal plane to values as shown in Table 2 under the foregoing conditions, to evaluate the dirt of the developer container due to the adhesion of the powdered developer and show the results thereof in the same table 2.

The dirt of the developer container is evaluated in the same manner as that in the above described experiments.

TABLE 2

| Experiment | H [mm] | h [mm] | α (°) | evaluation of dirt |
|---|---|---|---|---|
| 8 | 25 | 10 | −22 | Δ |
| 9 | 25 | 10 | −17 | ○ |
| 10 | 25 | 10 | −10 | ◎ |
| 11 | 25 | 10 | 0 | ◎ |
| 12 | 25 | 10 | +10 | ○ |
| 13 | 25 | 10 | +15 | Δ |
| 14 | 25 | 20 | −8 | Δ |
| 15 | 25 | 20 | −3 | ○ |
| 16 | 25 | 20 | 0 | ◎ |
| 17 | 25 | 20 | +23 | ○ |
| 18 | 25 | 20 | +28 | Δ |
| 19 | 25 | 25 | −5 | Δ |
| 20 | 25 | 25 | 0 | Δ |
| 21 | 25 | 25 | +5 | ○ |
| 22 | 25 | 25 | +15 | ◎ |
| 23 | 25 | 25 | +28 | ○ |
| 24 | 25 | 25 | +33 | Δ |
| 25 | 30 | 10 | −28 | Δ |
| 26 | 30 | 10 | −23 | ○ |
| 27 | 30 | 10 | −10 | ◎ |
| 28 | 30 | 10 | +10 | ○ |
| 29 | 30 | 10 | +15 | Δ |

In the experiments in which air injected from the injection port of the injection nozzle is blown into the mouth portion of the developer container, the powdered developer contained in the developer container is blown up, and the powdered developer thus blown up adheres to the outer wall of the developer container. In addition, in the experiments in which air injected from the injection port of the injection nozzle is blown into the feed port of the feed nozzle, the developer adhering to, for example, the inner peripheral surface of the feed nozzle is scattered, and the powdered developer thus scattered adheres to the outer wall of the developer container.

EXPERIMENTS 30 TO 41

In the experiments, the diameter (l) of the feed port of the feed nozzle is taken as 30 mm, the diameter (L) of the mouth portion of the developer container is taken as 45 mm, the distance from the injection port to the dust collecting hood is taken as 50 mm, the distance (H) in the vertical direction between the lower end of the feed port of the feed nozzle and the upper end of the mouth portion of the developer container in the retreat position is taken as 25 mm, the distance (h) in the vertical direction between the lower end of the feed port of the feed nozzle and the injection port of the injection nozzle is taken as 25 mm which is approximately the same as the above described distance (H), the distance (x) in the horizontal direction between the mouth portion of the developer container and the injection port of the injection nozzle is taken as approximately 0 mm, and the angle (α) which the injection port of the injection nozzle makes with the horizontal plane is taken as −10°.

Experiments are conducted by changing the velocity of injection ($v_1$) of air injected from the injection port of the injection nozzle and the amount of injection ($m_1$) of the air as well as the velocity of suction ($v_2$) of air by the dust collecting hood (31) and the amount of suction ($m_2$) of the air to values as shown in Table 3 under the foregoing conditions, to evaluate the dirt of the developer container due to the adhesion of the powdered developer and show the results thereof in the same table 3.

Meanwhile, the dirt of the developer container is evaluated in the same manner as that in the above described experiments.

TABLE 3

| Experiment | $v_1$ [m/sec] | $m_1$ [$m^3$/min] | $v_2$ [m/sec] | $m_2$ [$m^3$/min] | evaluation |
|---|---|---|---|---|---|
| 30 | 10 | 1.0 | 20 | 1.2 | Δ |
| 31 | 10 | 1.0 | 25 | 1.9 | Δ |
| 32 | 10 | 1.0 | 40 | 3.5 | Δ |
| 33 | 15 | 1.3 | 20 | 1.2 | Δ |
| 34 | 15 | 1.3 | 25 | 1.9 | Δ |
| 35 | 15 | 1.3 | 40 | 3.5 | Δ |
| 36 | 20 | 2.2 | 20 | 1.2 | Δ |
| 37 | 20 | 2.2 | 25 | 1.9 | Δ |
| 38 | 20 | 2.2 | 25 | 2.5 | ○ |
| 39 | 20 | 2.2 | 40 | 3.5 | ◎ |
| 40 | 25 | 3.0 | 25 | 3.0 | ○ |
| 41 | 25 | 3.0 | 40 | 3.5 | ◎ |

As a result of the experiments, it is preferable that the velocity of injection ($v_1$) of air injected from the injection port of the injection nozzle and the amount of injection ($m_1$) of the air as well as the velocity of suction ($v_2$) of air by the dust collecting hood 31 and the amount of suction ($m_2$) of the air satisfy the following conditions:

$$v_1 \leqq v_2: \quad v_1 \geqq 20 \text{ [m/sec]}$$

$$v_2 \geqq 25 \text{ [m/sec]}$$

$$m_1 \leqq m_2: \quad m_1 \geqq 1.0 \text{ [m}^3\text{/sec]}$$

$$m_2 \geqq 1.2 \text{ [m}^3\text{/sec]}$$

EXPERIMENT 42

In this experiment, the diameter (1) of the feed port of the feed nozzle is taken as 30 mm, the diameter (L) of the mouth portion of the developer container is taken as 45 mm, the distance from the injection port to the dust collecting hood is taken as 50 mm, the distance (H) in the vertical direction between the lower end of the feed port of the feed nozzle and the upper end of the mouth portion of the developer container in the retreat position is taken as 25 mm, the distance (h) in the vertical direction between the lower end of the feed port of the feed nozzle and the injection port of the injection nozzle is taken as 25 mm which is approximately the same as the above described distance (H), the distance (x) in the horizontal direction between the mouth portion of the developer container and the injection port of the injection nozzle is taken as approximately 0 mm, the angle ($\alpha$) which the injection port of the injection nozzle makes with the horizontal plane is taken as $-10°$, the amount of injection ($m_1$) of air injected from the injection port of the injection nozzle is taken as 3.0 $m^3$/min, and the amount of suction ($m_2$) of air by the dust collecting hood 31 is taken as 3.5 $m^3$/min.

The experiment is conducted using as the injection nozzle an injection nozzle having an injection port formed in the shape of a circular arc which is concave in its central part and has a diameter of 900 mm as shown in FIG. 7 under the foregoing conditions. As a result, there is no dirt of the developer container due to the adhesion of the powdered developer.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. In a powdered developer filling device for filling a developer container with a powdered developer, comprising:

a hopper for containing the powdered developer;

feeding means for feeding the developer contained in the hopper into a developer container, said feeding means including a feed port for feeding the developer through a mouth portion of the developer container;

conveying means for conveying the developer container to a feed position where the developer is fed into the developer container from the feeding means; and recovering means for recovering developer spilled from said feed port by blowing air against a vicinity of the feed port where the developer is fed into the developer container from the feeding means;

wherein the recovering means comprises:

injecting means for blowing air against the vicinity of the feed port where the developer is fed into the developer container from the feeding means; and sucking means provided on an opposite side of said feed port with respect to said injecting means with the feed port being interposed therebetween for sucking developer spilled from said feed port together with the air blown from the injecting means;

a method comprising the steps of:

stopping the injection of air during a step of conveying the developer container by the conveying means to the feed position where the feed port of the feeding means and the mouth portion of the developer container are joined to each other so that the developer is fed into the developer container from a retreat position spaced apart from the feed position by a suitable distance, injecting air after the developer container filled with developer is conveyed to the retreat position, and continuously sucking air with the sucking means.

2. The method according to claim 1, wherein the retreat position is a position directly below the feed position where the developer is fed into the developer container and spaced apart from the feed position by a suitable distance.

3. The method according to claim 2, wherein the injecting means diagonally injects air upward so as to cross the direction in which the developer container is conveyed between the feed position and the retreat position.

4. A powdered developer filling device for filling a developer container with a powdered developer, comprising:

a hopper for containing the powdered developer;

feeding means for feeding the developer contained in the hopper into a developer container, said feeding means including a feed port for feeding the developer through a mouth portion of the developer container;

conveying means for conveying the developer container to a feed position where the developer is fed into the developer container from the feeding means; and recovering means for recovering developer spilled from said feed port by blowing air against a vicinity of the feed port where the developer is fed into the developer container from the feeding means;

wherein the recovering means comprises:

injecting means for blowing air against the vicinity of the feed port where the developer is fed into the developer container from the feeding means; and sucking means provided on an opposite side of said feed port with respect to said injecting means with the feed port being interposed therebetween for sucking developer spilled from said feed port together with the air blown from the injecting means.

5. The powdered developer filling device according to claim 1, wherein the injecting means has an injection nozzle for injecting air, an injection port in an end of the injection nozzle being formed in the shape of a circular arc which is concave in a central part.

6. The powdered developer filling device according to claim 4, wherein said feed port is arranged such that the developer fed from the feed port moves in a first direction, and said injecting means blows air in a second direction, said second direction being perpendicular to said first direction.

7. The powdered developer filling device according to claim 4, wherein said injecting means is arranged so as to blow air across an opening of said feed port.

8. The powdered developer filling device according to claim 4, wherein said injecting means is located downstream of an opening of said feed port with respect to a direction of flow of the developer.

9. A powdered developer filling device for filling a developer container with a powdered developer, comprising:

a hopper for containing the powdered developer;

feeding means for feeding the developer contained in the hopper into a developer container from a feed port through a mouth portion of the developer container;

conveying means for conveying the developer container to a feed position where the developer is fed into the developer container from the feeding means; and recovering means for recovering the developer spilled from said feed port by blowing air against a vicinity of the feed position where the developer is fed into the developer container from the feeding means;

wherein the recovering means comprises:

injecting means for blowing air against the vicinity of the feed position where the developer is fed into the developer container from the feeding means; and sucking means provided in a position on the opposite side to said injecting means with the feed position being interposed therebetween for sucking the developer spilled from said feed port together with the air blown from the injecting means;

wherein the injecting means and the sucking means satisfy the following conditions:

$$v_1 \leqq v_2: \quad v_1 \geqq 20 \text{ [m/sec]}$$
$$v_2 \geqq 25 \text{ [m/sec]}$$
$$m_1 \leqq m_2: \quad m_1 \geqq 1.0 \text{ [m}^3\text{/sec]}$$
$$m_2 \geqq 1.2 \text{ [m}^3\text{/sec]}$$

where $v_1$ denotes the velocity of injection of air by the injecting means, $v_2$ denotes the velocity of suction of air by the sucking means, $m_2$ denotes the amount of injection of the air by the injecting means, and $m_2$ denotes the amount of suction of the air by the sucking means.

* * * * *